United States Patent [19]

Stevens

[11] 4,183,563

[45] Jan. 15, 1980

[54] PANIC-PROOF LOCKSET

[75] Inventor: William Stevens, Monroe, N.C.

[73] Assignee: Scovill Manufacturing Company, Waterbury, Conn.

[21] Appl. No.: 854,862

[22] Filed: Nov. 25, 1977

[51] Int. Cl.[2] ..... E05B 63/14

[52] U.S. Cl. ..... 292/34; 70/107

[58] Field of Search ..... 292/34–36, 292/47–49, 139–140, 165, 167, 186, 196, 244–245; 70/107, 108, 109, 462

[56] References Cited

U.S. PATENT DOCUMENTS

| | | | |
|---|---|---|---|
| 3,910,613 | 10/1975 | Nolin | 292/34 |
| 3,999,789 | 12/1976 | Maurits | 292/34 |

*Primary Examiner*—Robert L. Wolfe

*Attorney, Agent, or Firm*—Marvin L. Union; Dallett Hoopes

[57] ABSTRACT

A panic-proof lockset includes a deadbolt and a spring latch. An interior escutcheon supports a knob for operating the spring latch and a second knob for operating the deadbolt. A crank is coupled to the second knob and a slide member is adapted to turn the crank either selectively clockwise or counterclockwise to a position generally corresponding to the open position of the deadbolt. The slide is in tension when acting on the crank to turn the crank to a position generally corresponding to the open position of the deadbolt. A cam means is provided for moving the slide member in response to rotary motion of the knob whereby the deadbolt and the spring latch are simultaneously retracted by turning the knob. This construction enables a user to rotate one knob to simultaneously retract the deadbolt and the spring latch, thereby providing easy exit in a panic situation.

2 Claims, 4 Drawing Figures

PANIC-PROOF LOCKSET

BACKGROUND OF THE INVENTION

1. Field of the Invention

The present invention relates to a panic-proof lockset having a deadbolt and a latchbolt and more specifically to a panic-proof lockset wherein a slide means is provided which is movable in response to retraction of the spring latch to simultaneously retract the deadbolt and wherein the slide means is in tension when acting to effect retraction of the deadbolt.

2. Background of the Invention

Panic-proof locksets are known in the art. In most of the known panic-proof locksets the construction is such as to be expensive, unnecessarily complicated, and unreliable. The complexity of such devices leaves much to be desired in providing a panic-proof lockset which is reliable, simple in construction, and yet economical.

One known problem associated with known panic-proof locksets is that when it is necessary to retract both the spring latch and the deadbolt with a common mechanism, sometimes one of the latches is fully retracted before the other is retracted. In such a case the fully retracted latch sometimes "bottoms out" and acts to limit further operation of the common operating mechanism, thus, preventing retraction of the other latch which is not fully retracted. Hence, the door associated therewith will not open and a dangerous situation exists. The nonsimultaneous retraction of the spring bolt and deadbolt can be due to varying dimensional tolerances caused either by wear of the lockset or manufacturing inaccuracies.

SUMMARY OF THE INVENTION

The present invention provides a new and improved panic-proof lockset including a deadbolt, a spring latch, an interior escutcheon, a knob supported by the interior escutcheon for operating the spring latch, a second knob supported by the escutcheon for operating the deadbolt and a crank coupled to the second knob. A slide member is provided for turning the crank either selectively clockwise or counterclockwise to a position generally corresponding to the open position of the deadbolt. The slide is in tension when acting on the crank to turn the crank to a position generally corresponding to the open position of the deadbolt. Means are also provided for moving the slide member in response to rotary motion of the knob whereby the deadbolt and the spring latch are simultaneously retracted upon turning the knob.

The present invention further provides a new and improved panic-proof lockset as set forth in the next proceeding paragraph wherein the slide member includes a lost motion connection means for interconnecting the slide member and the crank. The lost motion connecting means provides for movement of the crank to a position generally corresponding to the open position of the deadbolt upon movement of the slide member and provides for further movement of the slide member in the deadbolt opening direction without effecting further movement of the crank.

Still another provision of the present invention is to provide a new and improved panic-proof lock comprising a spring latch, a deadbolt, an interior escutcheon, a knob coupled to the spring latch and supported by the escutcheon and means for operating the deadbolt carried by the escutcheon. A crank is coupled to the deadbolt operating means and a slide means is carried by the escutcheon. The slide means is movable in response to rotary motion of the knob to retract the spring latch. The slide member includes first and second surface portions which are engageable with the crank, one of the surface portions of the slide means being adapted to turn the crank clockwise to a position generally corresponding to the open position of the deadbolt and the other of the surface portions being adapted to turn the crank counterclockwise to a position generally corresponding to the open position of the deadbolt. The slide means is in tension when acting on the crank to turn the crank to a position generally corresponding to the open position of the deadbolt. Means are also provided which are connected to the knob for moving the slide means in response to rotary motion of the knob whereby the deadbolt and the spring latch can be simultaneously retracted upon turning the knob.

DESCRIPTION OF THE PREFERRED EMBODIMENT

Figure 1:
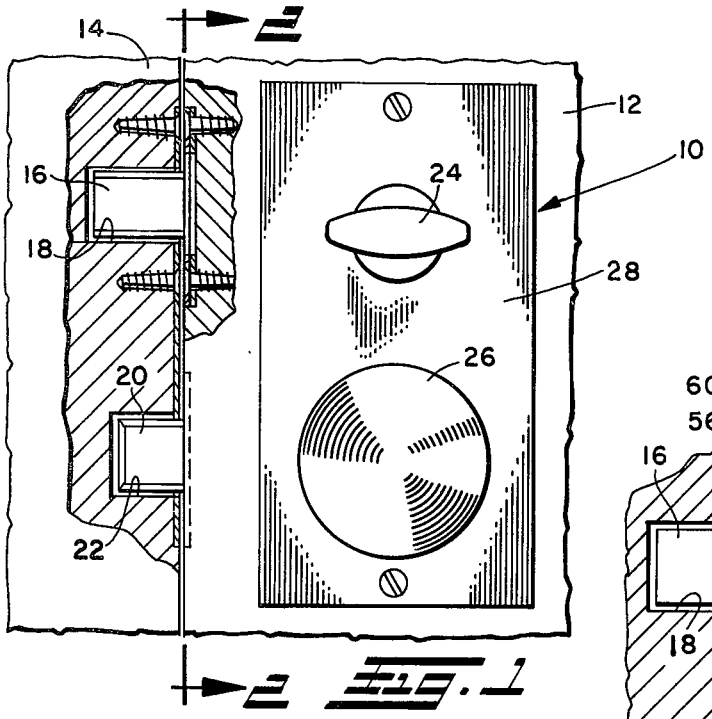
FIG. 1 is a plan view of the present lockset mounted on a door illustrating the spring latch and deadbolt in a partial cross-sectional view.

Referring to the figures, and more particularly to FIG. 1, a panic-proof lockset 10 is illustrated mounted on a door 12 adjacent its associated jamb 14. The panic-proof lockset 10 includes deadbolt mechanism 15 including a deadbolt 16 which is extendable from the lockset 10 into a recess 18 disposed in the jamb 14 of the door 12. The lockset 10 further includes a spring latch mechanism 19 including a spring latch 20 which is receivable in a recess 22 disposed in the jamb 14. Disposed on the interior side of the panic-proof lockset 10 is a thumb turn 24 which is rotatable to effect extension and retraction of the deadbolt 16 and a knob 26 which is rotatable to effect retraction of the spring bolt 20. The thumb turn 24 and the knob 26 are supported on an interior escutcheon 28.

Figure 2:
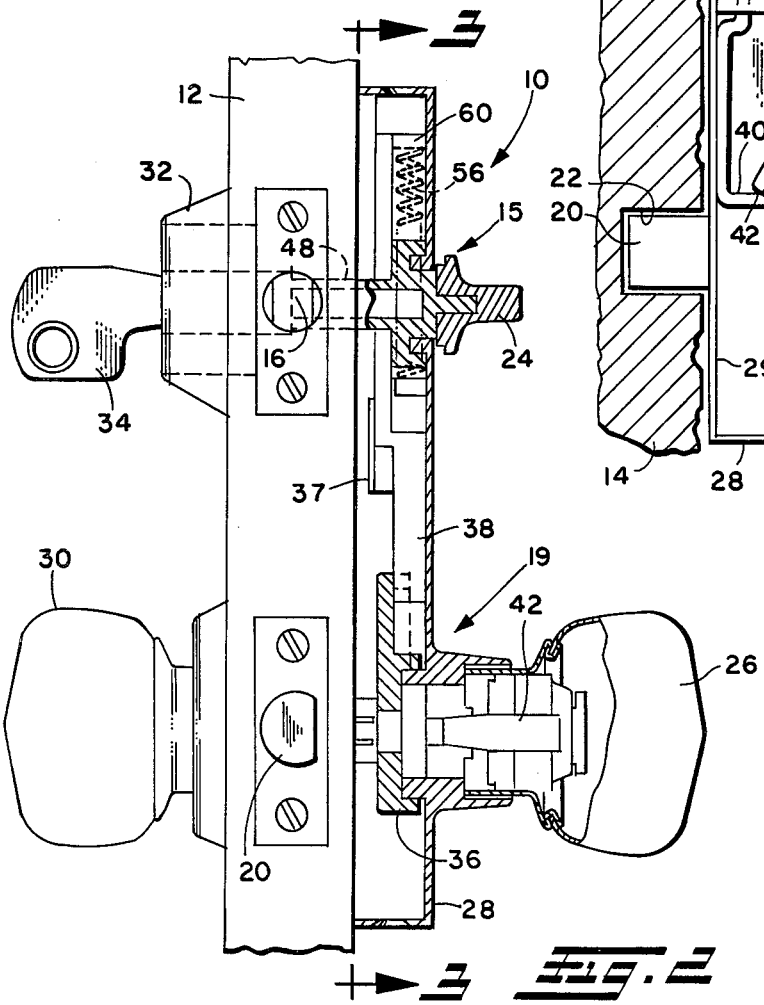
FIG. 2 is a partial cross-sectional view taken approximately along the line 2—2 of FIG. 1.

Referring more particularly to FIG. 2, the exterior of the lockset 10 includes a knob 30 which is connected to the spring bolt 20 in a well-known fashion. The knob 30 may include a lock cylinder therein (not illustrated) for locking the spring latch 20 in a well-known manner. Additionally, a deadbolt cylinder 32 is disposed on the exterior of the lockset 10 and connects with the deadbolt mechanism 15 to effect extension and retraction of the deadbolt 16 in a well-known manner. To this end, a key 34 is adapted to be received in the deadbolt cylinder 32 to effect actuation of the deadbolt 16.

The deadbolt mechanism 15 which includes the thumb piece 24, the deadbolt 16, and the deadbolt cylinder 32, includes an operating mechanism (not illustrated) which is located between the deadbolt cylinder 32 and the thumb piece 24 located on the interior escutcheon 28. A detailed description of the deadbolt operating mechanism will not be described as it is a well-known structure which is presently being utilized by Eaton Corporation in its 3211A deadbolt. Similarly, the spring latch mechanism 19 which includes the spring latch 20 and the knobs 26,30 includes an operating mechanism (not illustrated) which is disposed between the knob 26 supported on the interior escutcheon 28 and the outer knob 30 disposed on the exterior of the door 12. The operating mechanism for the spring latch 19 will also not be described in detail as it is presently being utilized by Eaton Corporation in their 5280 series lockset and as such is well known in the art.

The deadbolt assembly 15 and the latchbolt or springbolt assembly 19 are nonhanded which enables the deadbolt and latchbolt assemblies to be rearranged by rotating portions thereof in a well-known manner to enable the lockset 10 to be used with either a right-hand or a left-hand door. Thus, the latchbolt assemby 19 and deadbolt assembly 15 can be rotated so as to enable the panic-proof lockset 10 to be utilized with doors with different hands.

Disposed within the interior escutcheon 28 is a slide 38 which interconnects the deadbolt assembly 15 and the latchbolt assembly 19. The slide 38, as will be described more fully hereinbelow, enables the deadbolt assembly 15 to be independently extended and retracted and automatically retracted, if extended, whenever the latchbolt assembly 19 is retracted by the interior knob 26. This provides a panic-proof lockset in that the user only has to effect rotation of the interior knob 26 if both the latchbolt 20 and the deadbolt 16 are extended to effect simultaneous retraction of the latchbolt 20 and the deadbolt 16.

The slide 38 is supported for vertical movement within a chamber 27 disposed within the interior escutcheon 28. The slide 38 includes a pair of guide surfaces 31 which engage with a pair of interior side surfaces 29 of the escutcheon 28 to guide vertical movement of the slide 38 between its positions shown in FIG. 3 and FIG. 4. The slide 38 includes an additional pair of guide surfaces 33 which engage with guide members 35 disposed on the interior of the escutcheon 28 to further guide the vertical movement of the slide 38. A guide plate 37 is secured to the guide members 35 after the slide 38 is located in the escutcheon. The slide 38 is located in the escutcheon 28 by cooperation of the slide 38 with the guide members 35 and the guide surfaces 29. The guide plate holds the slide 38 within the chamber 27 and in contact with the guide surfaces 29 and guide members 35 to further guide movement of the slide 38 in a vertical direction. The guide plate 37, guide surfaces 29, 31 and guide members 35 prevent skewing of the slide 38 and allow only vertical movement thereof.

Figure 3:
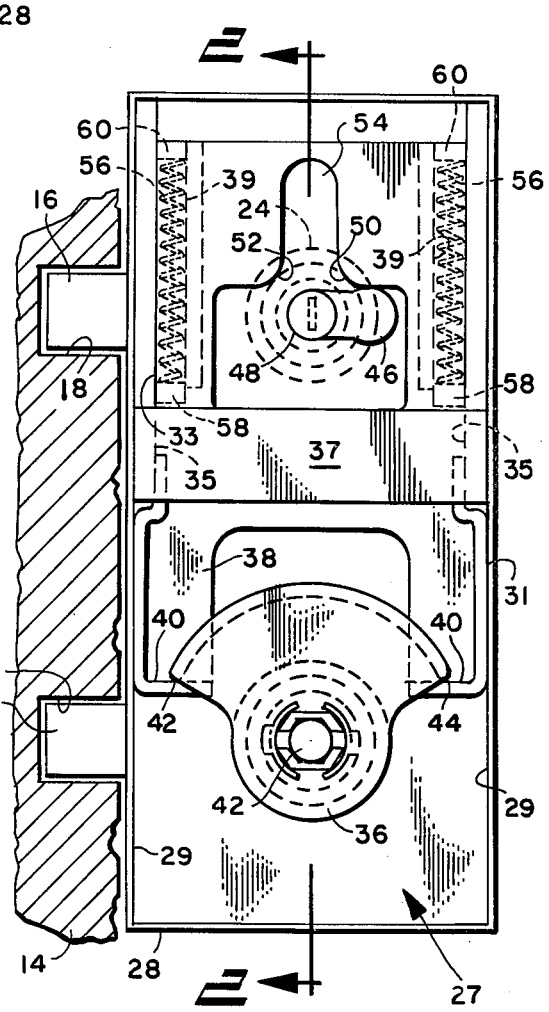
FIG. 3 is a cross-sectional view taken approximately along the line 3—3 of FIG. 2 illustrating the deadbolt and the spring latch in their locked position.
Figure 4:
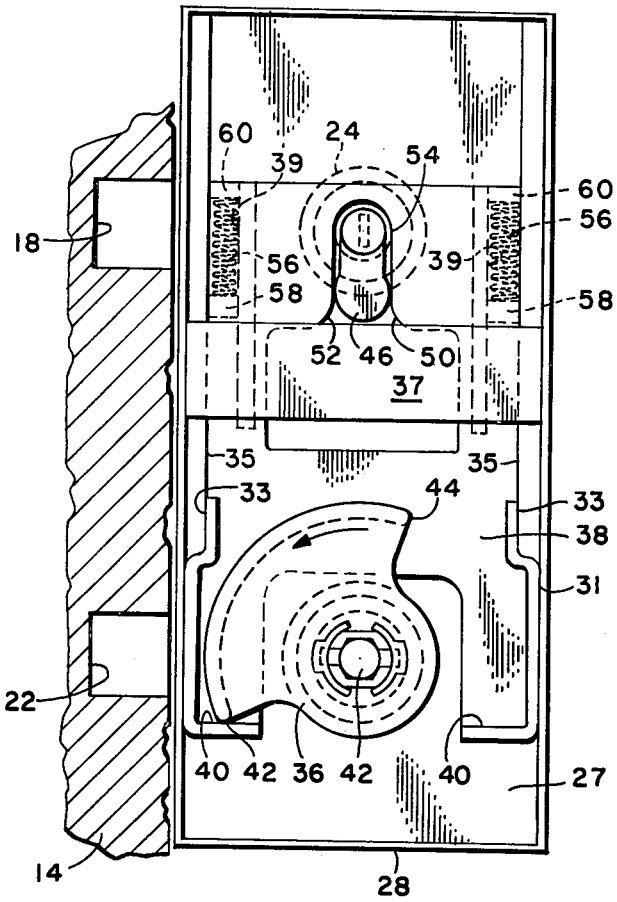
FIG. 4 is a cross-sectional view similar to FIG. 3 but illustrating the deadbolt and spring latch in their unlocked condition.

The slide 38 includes a pair of channels 39 disposed on opposite sides thereof. A pair of return springs 56, one of which is disposed in each of the channels 39, is provided to continuously urge the slide 38 in an upward vertical direction as is illustrated in FIG. 3 and FIG. 4. Each of the springs 56 is disposed between a shoulder 58 disposed on the interior of the escutcheon 28 and a shoulder 60 disposed on the slide member 38. The springs 56 act on the slide 38 via the shoulder 60 to urge the slide 38 upwardly to its position illustrated in FIG. 3. To this end the springs 56 cooperate to ensure that the latchbolt 20 always returns to its extended position when either of the knobs 26 or 30 is released. It should be appreciated that the upward movement of the slide 38 under the influence of springs 56 will rotate cam 36 to its position illustrated in FIG. 3 to ensure the latchbolt 20 is extended. Upward movement of the slide 38 will not effect movement of the deadbolt 16.

The slide 38 includes a pair of horizontal surfaces 40 which are adapted to engage with a cam 36. The cam 36 is connected to a spindle 42 of the latchbolt assembly 19 for rotation therewith. The cam 36 includes a pair of end surfaces 42 and 44 which engage with the horizontal surfaces 40 to effect downward vertical movement of the slide 38 upon rotation of the cam 36. It will be apparent that the cam surface 42 will engage with the horizontal surface 40 when cam 36 is rotated in a counterclockwise direction and the cam surface 44 will engage with the horizontal surface 40 of the slide 38 when the cam 36 is rotated in a clockwise direction. Rotation of the interior knob 26 of the latchbolt assembly 19 in a clockwise or counterclockwise direction as viewed in FIG. 3 and FIG. 4 will cause the cam 36 to engage with one of the horizontal surfaces 40 of the slide 38 as the cam 36 rotates from its position as illustrated in FIG. 3 to its position illustrated in FIG. 4. In addition, rotation of the interior knob 26 will cause retraction of the latchbolt 20. Thus, engagement of the cam 36 with one of the horizontal surfaces 40 of the slide 38 will effect a downward movement of the slide 38 in response to rotation of the cam 36 and retraction of the latchbolt 20. The provision of a pair of horizontal surfaces 40 on the slide 38 and a pair of surfaces 42, 44 on the cam 36 which engage with the surfaces 40 allows the latchbolt assembly 19 to have a nonhanded configuration. This enables the slide 38 to move in a downward vertical direction upon retraction of the latchbolt 20 on either a right-handed or a left-handed door regardless of the direction of rotation of the knob 26.

The deadbolt assembly 15 includes a spindle 48 which is connected in a well-known manner to the deadbolt cylinder 32 and the knob 24 to rotate therewith upon extension and retraction of the deadbolt 16. A crank 46 is connected to the spindle 48 for rotation therewith. The crank 46 assumes the position shown in FIG. 3 when the deadbolt 16 is in its extended position and assumes the position shown in FIG. 4 when the deadbolt 16 is in its retracted position. The crank 46 may also assume a position located 180 degrees from the position illustrated in FIG. 3 when the deadbolt 16 is extended if the panic-proof lockset 10 is associated with a door 12 of the opposite hand.

The slide member 38 includes a pair of surfaces 50 and 52 which are operable to engage with the crank 46 upon downward movement of the slide 38 affected by rotation of the knob 26 and cam 36. When the deadbolt 16 is extended and the crank 46 is in its position illustrated in FIG. 3, downward movement of the slide 38 will cause the surface 50 of the slide 38 to engage with crank 46 to position the crank 46 in its position illustrated in FIG. 4 when the cam 36 and knob 26 are fully rotated to retract spring latchbolt 20. When the crank 46 is in its position illustrated in FIG. 3, the deadbolt 16 will be in its extended position and when the crank 46 is rotated by the slide 38 to its position illustrated in FIG. 4, the deadbolt 16 will be retracted. Thus, retraction of the spring latchbolt 20 upon rotation of knob 26 will effect downward movement of slide 38 which ensures that crank 46 assumes the position illustrated in FIG. 4 to ensure that deadbolt 16 is retracted. It will also be appreciated that when the deadbolt assembly 15 is utilized with a door having the opposite hand of the door illustrated in the present figures, the crank 46 will be disposed 180 degrees from that illustrated in FIG. 3 when the deadbolt 16 is extended. In this case the crank 46 will be in a position to engage with the surface 52 of the slide 38 to effect retraction of the deadbolt 16 when the slide 38 moves in a downwardly direction upon rotation of cam 36.

The surfaces 50 and 52 on the slide 38 cooperate to form a slot 54 which helps to positively position the crank 46 upon downward movement of the slide 38 and retraction of the deadbolt 16. The surfaces 50 and 52 positively position the crank 46 in its position illustrated in FIG. 4 upon downward movement of slide 38 by trapping the crank in slot 54 upon retraction of deadbolt 16. The slot 54 also provides for overtravel of the slide 38 in a downwardly direction once the crank 46 has been located in its position illustrated in FIG. 4 and the deadbolt 16 has been retracted. The overtravel provided by the slot 54 prevents the deadbolt assembly 15 from bottoming out upon being fully retracted and thereby preventing further downward movement of slide 38 and full retraction of the latchbolt 20. This could occur due to manufacturing inaccuracies or wear in the lockset if the present overtravel were not provided. This is a common problem in nonhanded designs that force a deadbolt cam to return to a neutral position after it has been previously thrown to either side of the neutral position to extend the deadbolt. The overtravel provided by slot 54 enables the slide 38 to position the deadbolt cam 46 in its deadbolt retracted position while providing for additional downward movement of slide 38 to ensure that the latchbolt 16 is fully retracted. If overtravel were not provided and the deadbolt 16 was fully retracted when the end of the slot 54 engaged with the crank 46 and the latchbolt 20 was not fully retracted, then further retraction of the latchbolt 20 would be prevented due to the fact that engagement of the crank 48 and the slot 54 would prevent further downward movement of slide 38 and rotation of cam 36. Thus, the present structure insures the retraction of the deadbolt 16 and retraction of the latchbolt 20 and increases the reliability of the product while allowing decreased product cost due to greater dimensional tolerances.

It should be apparent that the spring latch 20 will always be biased to its extended position unless the knobs 26 or 30 are rotated to effect retraction thereof. The deadbolt 16 may be operated independently of the latchbolt 20 as long as the latchbolt 20 is in its extended position. To this end, when the latchbolt 20 is extended as illustrated in FIG. 3, the deadbolt 16 may either be retracted or extended merely by actuating the thumb turn 24 or the cylinder 32. When the latchbolt 20 is retracted, the slide 38 will move in a downwardly direction and move the deadbolt 16 to its retracted position if the deadbolt 16 was not previously in its retracted position.

The present structure is such that the latchbolt assembly 19, the deadbolt assembly 15, and the interconnection therebetween is nonhanded. This allows the cam 36 to rotate in either a clockwise or counterclockwise direction to effect retraction of the latchbolt 20 and downward vertical movement of the slide 38. Downward vertical movement of the slide 38 will effect movement of the deadbolt cam 46 to its position illustrated in FIG. 4 to retract deadbolt 16. The downward movement of the slide 38 may effect either clockwise or counterclockwise movement of the deadbolt cam 46 depending on the hand of the door. Thus, the present lockset 10 provides a "panic-proof" function in that both the deadbolt 16 and the latchbolt 20 can be simultaneously retracted from the interior of the door by effecting rotation of the knob 26. This is desirable in a panic situation wherein with a normal deadbolt/latchbolt combination it might be forgotten that both the knob and deadbolt thumb turn must be rotated in order to open the door. The present structure eliminates any possibility that the deadbolt and latchbolt will not be simultaneously retracted.

From the foregoing it should be apparent that a new and improved panic-proof lockset has been provided. The panic-proof lockset includes a deadbolt, a spring latch, an interior escutcheon, a knob supported by the interior escutcheon for operating the spring latch and a second knob supported by the interior escutcheon for operating the deadbolt. A crank is coupled to the second knob and a slide member is adapted to turn the crank either selectively clockwise or counterclockwise to a position generally corresponding to the open position of the deadbolt. The slide is in tension when acting on the crank to turn the crank to a position generally corresponding to the open position of the deadbolt. Means are also provided for moving the slide in response to rotary motion of the knob whereby the deadbolt and the spring latch may be simultaneously retracted upon turning the knob.

I claim:

1. In a panic-proof lockset comprising:

(a) a spring latch;

(b) a deadbolt spaced from the spring latch;

(c) an interior escutcheon;

(d) a knob coupled to said spring latch and supported by said escutcheon;

(e) a cam within the escutcheon and coupled to the knob and disposed intermediate the knob and latch;

(f) a rotatable thumbpiece carried by said escutcheon for operating said deadbolt;

(g) a crank inside the escutcheon and coupled to said thumbpiece;

(h) a reciprocable slide member within said escutcheon and movable by the cam in response to rotary motion of said knob to retract said spring latch, said slide member including first and second surface portions normally on the opposite side of the crank from the spring latch and which are engageable with said crank, one of said surface portions of said slide member being adapted as the slide member moves toward the latch to turn said crank clockwise to a position at which it points toward the latch and retracts said deadbolt, and the other of said surface portions being adapted as the slide member moves toward the latch to turn said crank counterclockwise to a position at which it points toward the latch and retracts said deadbolt, the improvement wherein said surfaces are spaced apart wider than the width of the crank so that the end of the travel of the slide member toward the latch is not defined by engagement of the crank with both surface portions simultaneously, and wherein the slide member is slotted between the surfaces from one surface to the other, the slot extending with parallel margins from said surfaces in a direction away from the latch a distance such that the end of the travel of the slide member toward the latch is not defined by the engagement of the crank and the slide member at the end of the slot and the slide member amply clears the crank whereby in operation the latch is invariably retracted before the travel of the slide member toward the latch is blocked by the crank.

2. The improvement claimed in claim 1 wherein the cam in operation pulls the slide member in a direction toward the latch so that the slide member in operation is in tension.

* * * * *